US007331543B2

(12) United States Patent
Yu Chen

(10) Patent No.: US 7,331,543 B2
(45) Date of Patent: Feb. 19, 2008

(54) STRAP REEL SUPPORT DEVICE FOR A STRAP REEL STAND

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 302 days.

(21) Appl. No.: 11/088,818

(22) Filed: Mar. 25, 2005

(65) Prior Publication Data

US 2006/0214070 A1 Sep. 28, 2006

(51) Int. Cl.
*B65H 16/04* (2006.01)

(52) U.S. Cl. ..... 242/597.4; 242/577; 242/577.2; 242/577.3; 242/577.4

(58) Field of Classification Search ..... 242/597, 242/597.4, 397.2, 403, 403.1, 404, 406, 407, 242/577, 533.8, 597.7–597.8, 407.1, 571, 242/577.2–577.4, 601, 607
See application file for complete search history.

(56) References Cited

U.S. PATENT DOCUMENTS 1,943,512 A * 1/1934 Becker ..... 242/577.1
2,506,354 A * 5/1950 Green ..... 242/422.4
4,006,865 A * 2/1977 Howard ..... 242/388.7
5,025,999 A * 6/1991 Littrell ..... 242/577
6,655,627 B2 * 12/2003 Patton ..... 242/397.2
7,004,422 B1 * 2/2006 Chen ..... 242/588
2003/0085316 A1 * 5/2003 Mostowy ..... 242/557

* cited by examiner

*Primary Examiner*—Peter M. Cuomo
*Assistant Examiner*—Sang Kim
(74) *Attorney, Agent, or Firm*—Ming Chow; Sinorica, LLC

(57) ABSTRACT

A strap reel support device for a strap reel stand includes a telescopic rod unit pivotally fitted on a transverse shaft secured on the upper center of a frame body. The telescopic rod unit is equidistantly secured thereon with three main rods radially extending outward and respectively fitted therein with a telescopic support rod. The three support rods of the telescopic rod unit are able to be adjusted to extend outward or contract inward to have their outer ends pushing and supporting the inner wall of different-sized packing strap reels. An inner disc and an outer disc are fitted on the shaft of the stand body for restricting and positioning the inner and the outer side of the packing strap.

11 Claims, 8 Drawing Sheets

STRAP REEL SUPPORT DEVICE FOR A STRAP REEL STAND

BACKGROUND OF THE INVENTION

1. Field of the Invention

This invention relates to a strap reel support device for a strap reel stand, particularly to one able to be applied for supporting different-sized packing strap reels.

2. Description of the Prior Art

A conventional strap reel stand is provided with a stand body, a transverse shaft, an inner disc and an outer disc. The transverse shaft is secured at the upper end of the frame body. The inner disc is provided with a hollow threaded rod in the center to be fitted on the transverse shaft, and the outer disc is fitted on the hollow threaded rod of the inner disc. The inner and the outer disc have their opposite sides respectively fixed with a annular projection to be engaged with the opposite inner walls of a packing strap reel for positioning the packing strap positioned between the inner and the outer disc of the stand body.

However, the two annular projections provided on the opposite sides of the inner and the outer disc for supporting and positioning the packing strap reel are constant in size so they are only applicable to single-sized packing straps.

SUMMARY OF THE INVENTION

The objective of the invention is to offer a strap reel support device for a strap reel stand, including a telescopic rod unit, an inner disc, an outer disc and a strap-pressing member. The telescopic rod unit is pivotally fitted on a transverse shaft secured on the upper central portion of a frame body and is equidistantly secured thereon with three main rods diametrically extending outward and respectively fitted therein with a telescopic support rod adjustable in its position. The inner disc and the outer disc are fitted on the transverse shaft and respectively positioned at the inner and the outer side of the telescopic rod unit. Thus, the three support rods of the telescopic rod unit can be adjusted to extend outward or contract inward to have their outer ends pushing and propping the inner walls of different-sized packing strap reels, and the inner and the outer disc fitted on the transverse shaft can respectively restrict and position the inner and the outer side of the packing strap, able to stably support and position the packing strap.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
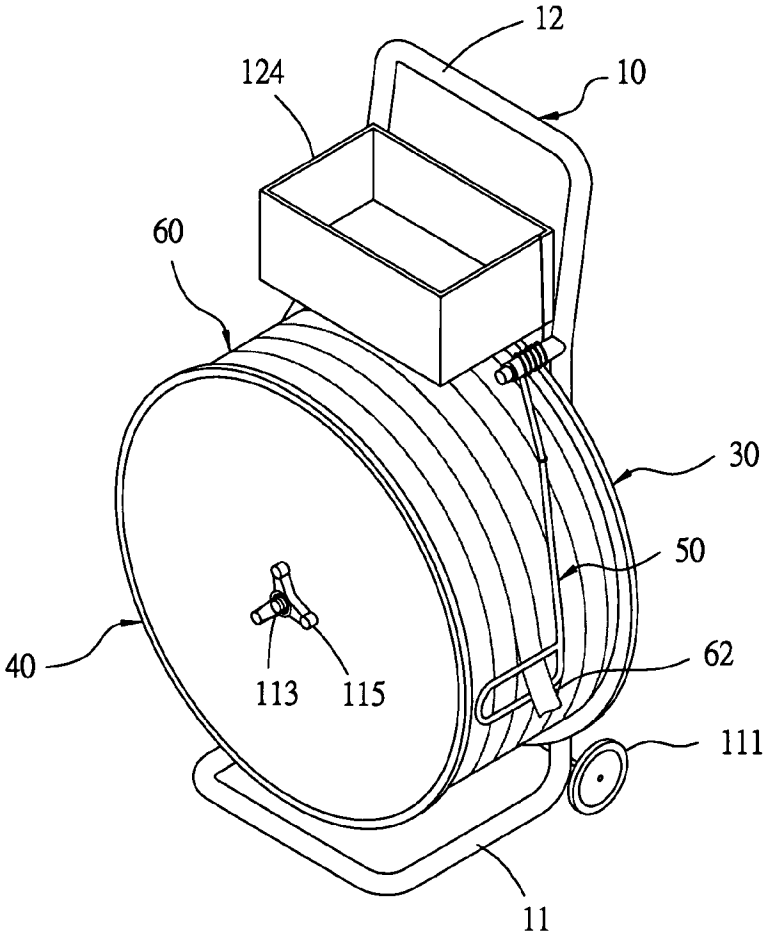
FIG. 1 is a perspective view of a strap reel support device for a strap reel stand in the present invention.
Figure 2:
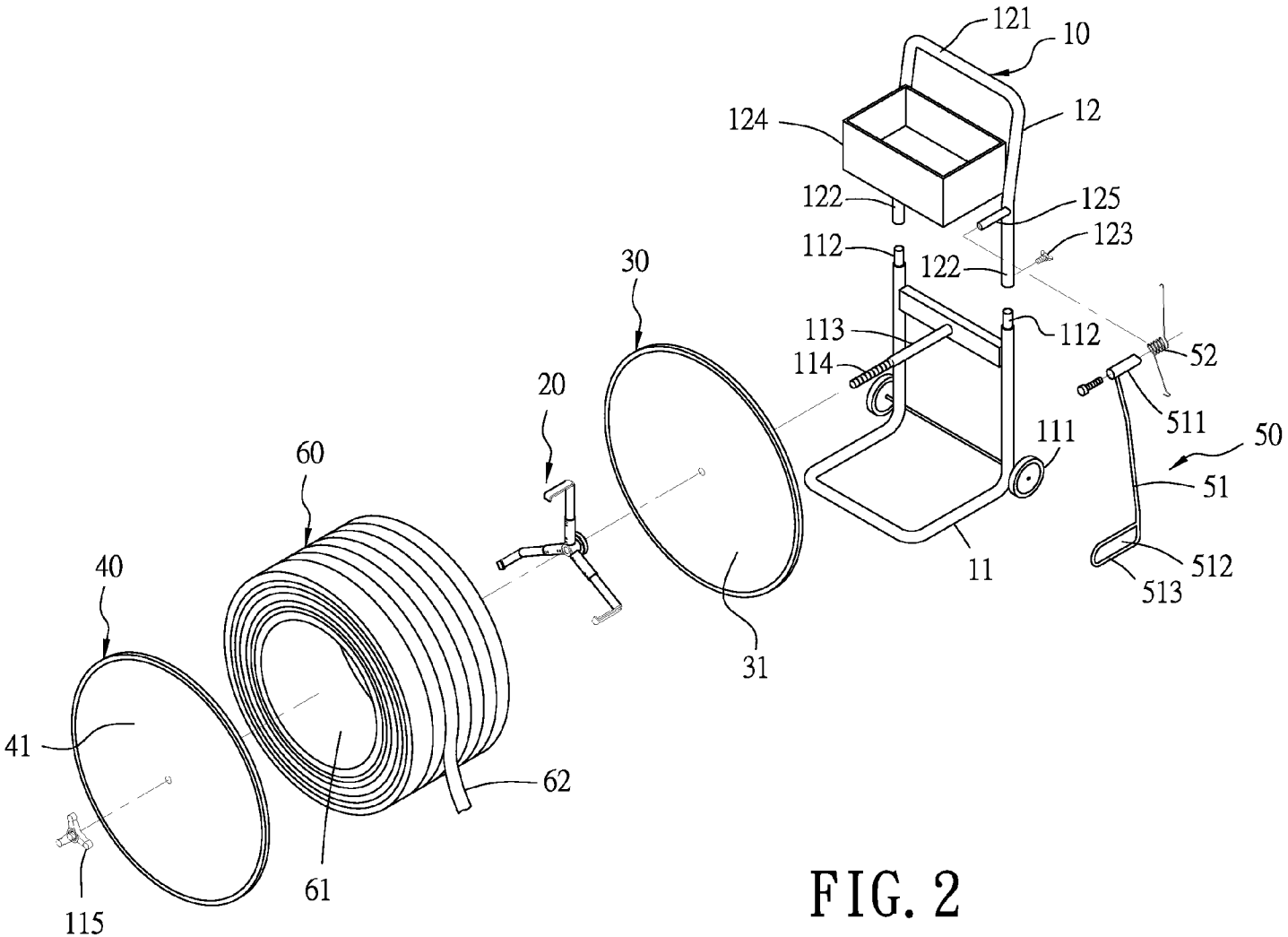
FIG. 2 is an exploded perspective view of the strap reel support device for a strap reel stand in the present invention.

A preferred embodiment of a strap reel support device for a strap reel stand in the present invention, as shown in FIGS. 1 and 2, includes a stand body 10, a telescopic rod unit 20, an inner disc 30, an outer disc 40 and a strap pressing member 50 combined together.

The stand body 10 is composed of a bottom frame 11 and a push handle 12. The bottom frame 11 has the opposite sides of its lower end respectively and pivotally assembled with a caster 111 and the opposite sides of its upper end respectively formed with an insert rod 112 extending upward. The push handle 12 shaped as an inverted U has it upper end formed with a horizontal push rod 121 and its opposite lower sides respectively formed with a sleeve 122 extending downward to be respectively mounted on the two insert rods 112 of the bottom frame 11. Each sleeve 122 has its lower outer wall screwed with a bolt 123 for pushing and fixing the insert rod 112 inserted in the interior of the sleeve 122. Further, the push handle 12 has its upper front side provided with an article-depositing box 124 and one sleeve 122 formed integral with a fixing rod 125 extending forward at a proper location. The bottom frame 11 further has its upper central portion secured with a transverse shaft 113 extending forward horizontally and having its outer end portion formed with male threads 114 to be screwed with a tightening nut 115.

The telescopic rod unit 20 is formed with a tubular base 21 bored with an axial through hole 211 in the center to be pivotally fitted on the shaft 113 of the stand body 10. The tubular base 21 has its outer circumferential wall equidistantly fixed with three main rods 22 extending outward radially and having their walls respectively bored with four engage holes 221 arranged axially in a line. The three main rods 22 have their interiors respectively and pivotally fitted with a support rod 23 having a V-shaped elastic engage member 24 secured in the interior. Each V-shaped elastic engage member 24 has one end fixed with an engage stud 241 protruding out of the outer wall of the support rod 23 and able to be elastically pressed inward. After the support rod 23 is inserted in the interior of the main rod 22, the engage stud 24 of the elastic engage member 24 can be engaged with any one of the four engage holes 221 of the main rod 22 to secure stably the support rod 23 at a position to after extending or contracting axially in the main rod 22. Further, each support rod 23 has its outer end formed integral with a basic plate 231 extending transversely and bored with a transverse guiding slot 232 having a propping plate 233 movably fitted thereon. The propping plate 233 is bored with a threaded hole 234 at a proper location, with a bolt 235 inserted through the transverse guiding slot 232 of the basic plate 231 and screwed with the threaded hole 234 of the propping plate 233. Thus, by properly unscrewing the bolt 235, the propping plate 233 can be shifted back and forth on the basic plate 231 along the transverse guiding slot 232. The propping plate 233 has its front end bent inward to form a curved guiding surface 236.

The inner disc 30 is bored with a shaft hole 31 in the center to be fitted on the shaft 113 of the stand body 10 and positioned at the inner side of the telescopic rod unit 20.

The outer disc 40 is bored with a shaft hole 41 in the center to be fitted on the shaft 113 of the frame body 10 and positioned at the outer side of the telescopic rod unit 20. The outer disc 40 is tightly pushed inward by a tightening nut 115 screwed with the outer threaded end of the shaft 113.

The strap-pressing member 50 consists of a properly curved press rod 51 and a torsion spring 52. The press rod 51 has it upper end fixed with a sleeve 511 to be fitted on the fixing rod 125 of the stand boy 10 and its tower end bent into a strap shoving part 513 with a strap passing slot 512. The torsion spring 52 is fitted on the sleeve 511 of the press rod 51, having its upper end hooked with a corresponding wall of the article-depositing box 124 of the stand body 10 and its lower end pressed on an intermediate portion of the press rod 51. Thus, the strap shoving part 513 will be urged by the torsion of the torsion spring 52 and push on the packing strap positioned between the inner and the outer disc 30, 40.

Figure 3:
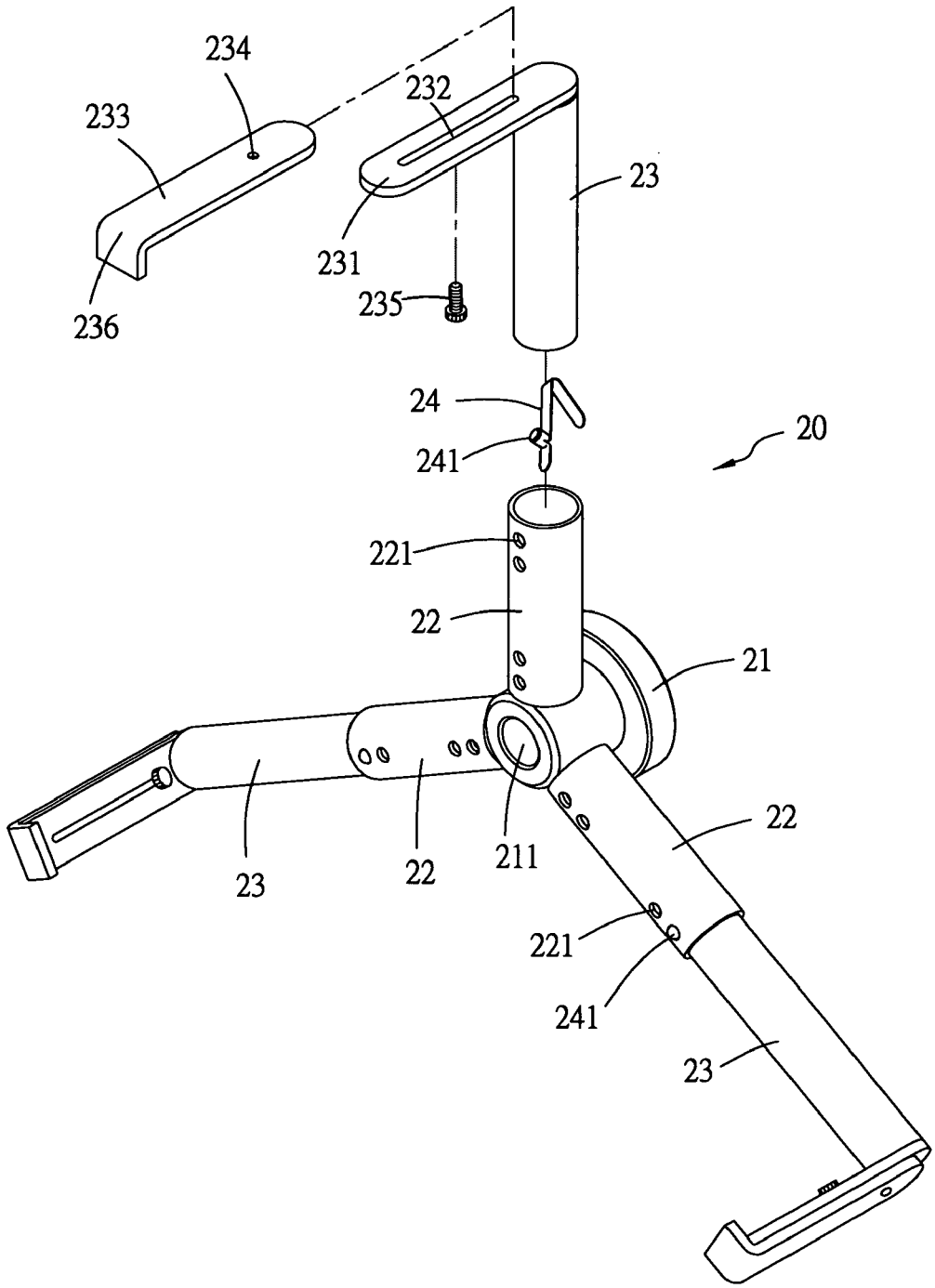
FIG. 3 is an exploded perspective view of a telescopic rod unit in the present invention.
Figure 4:
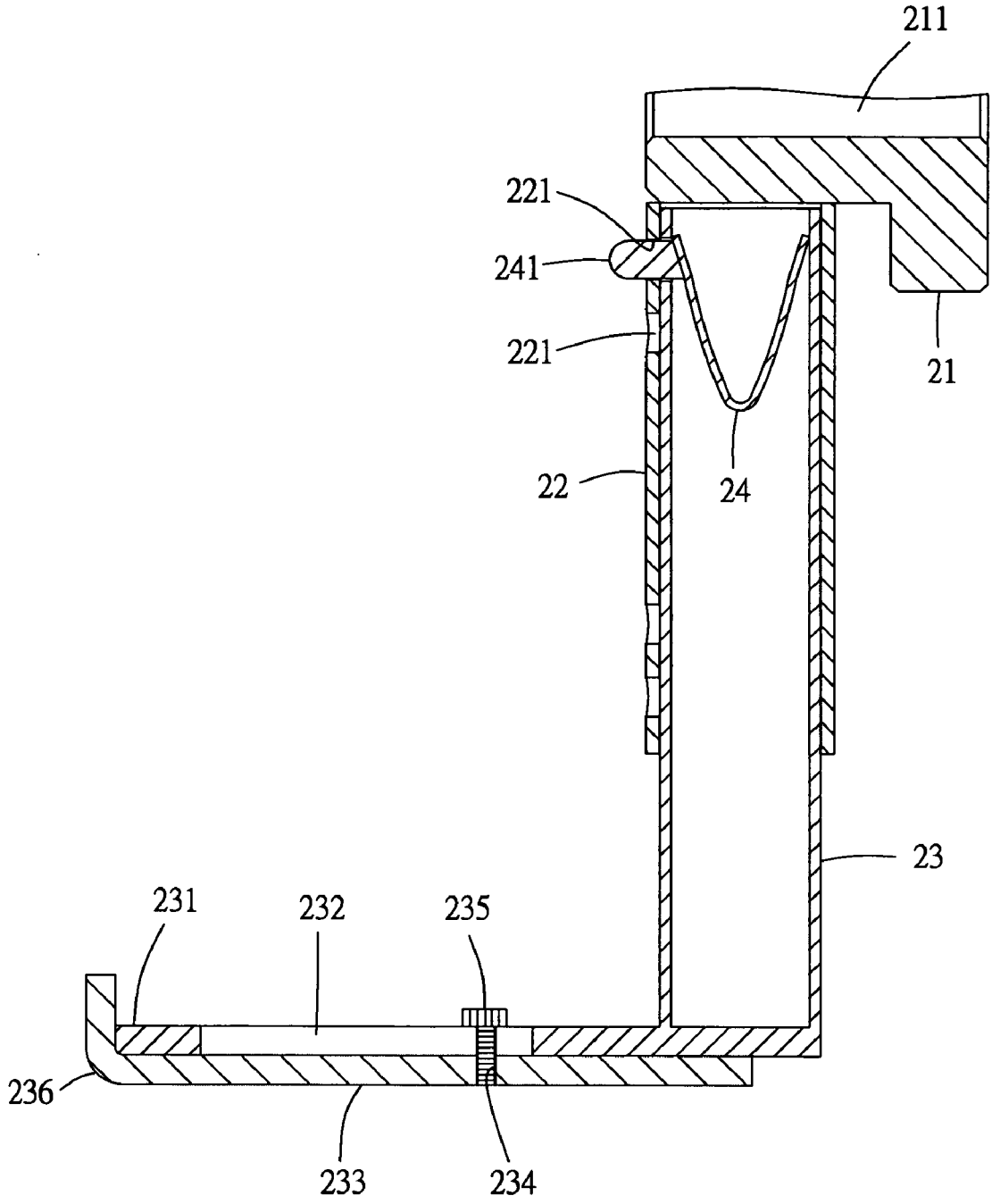
FIG. 4 is a partial side cross-sectional view of the telescopic rod unit in the present invention.
Figure 5:
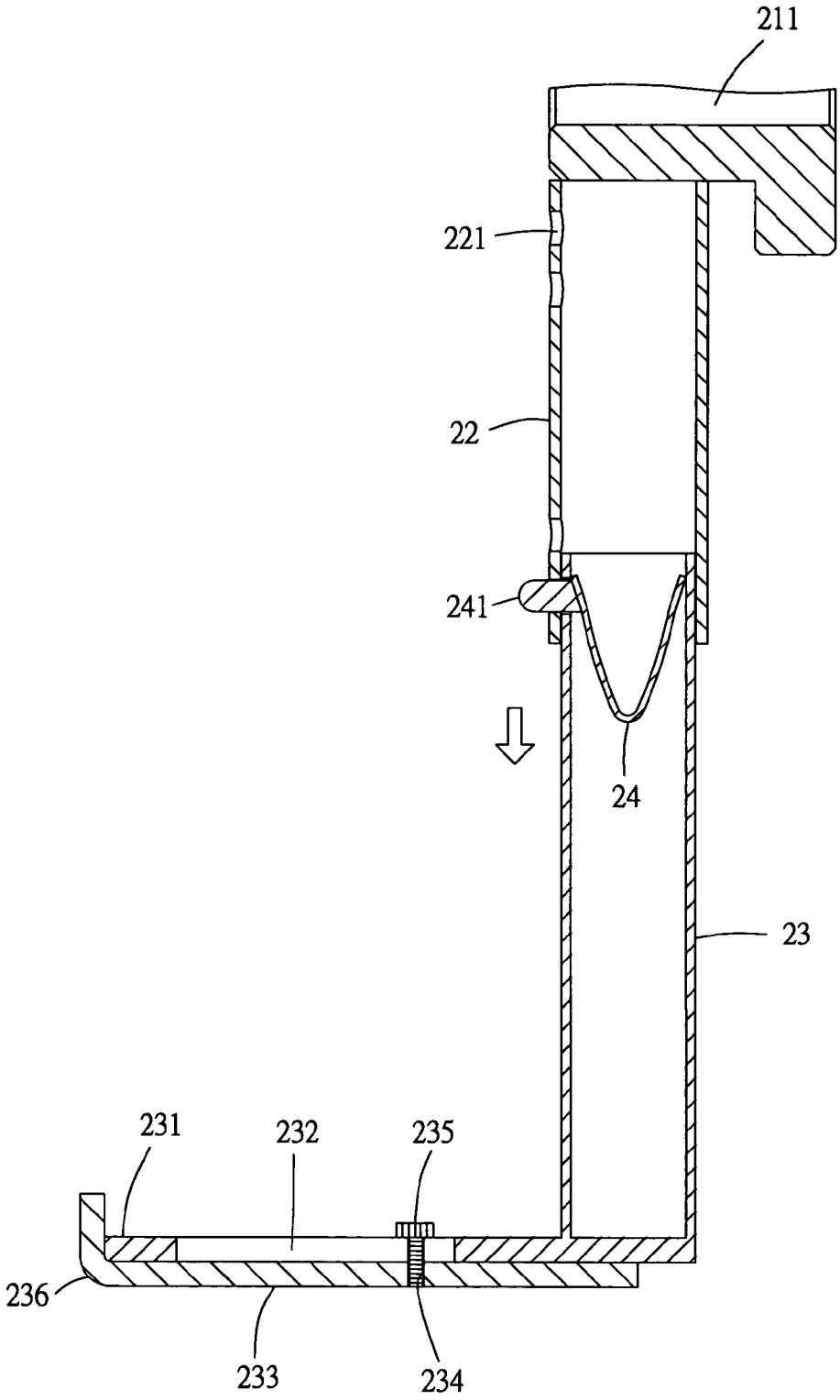
FIG. 5 is a partial side cross-sectional view of the support rods and the main rods of the telescopic rod unit in an extended condition in the present invention.
Figure 6:
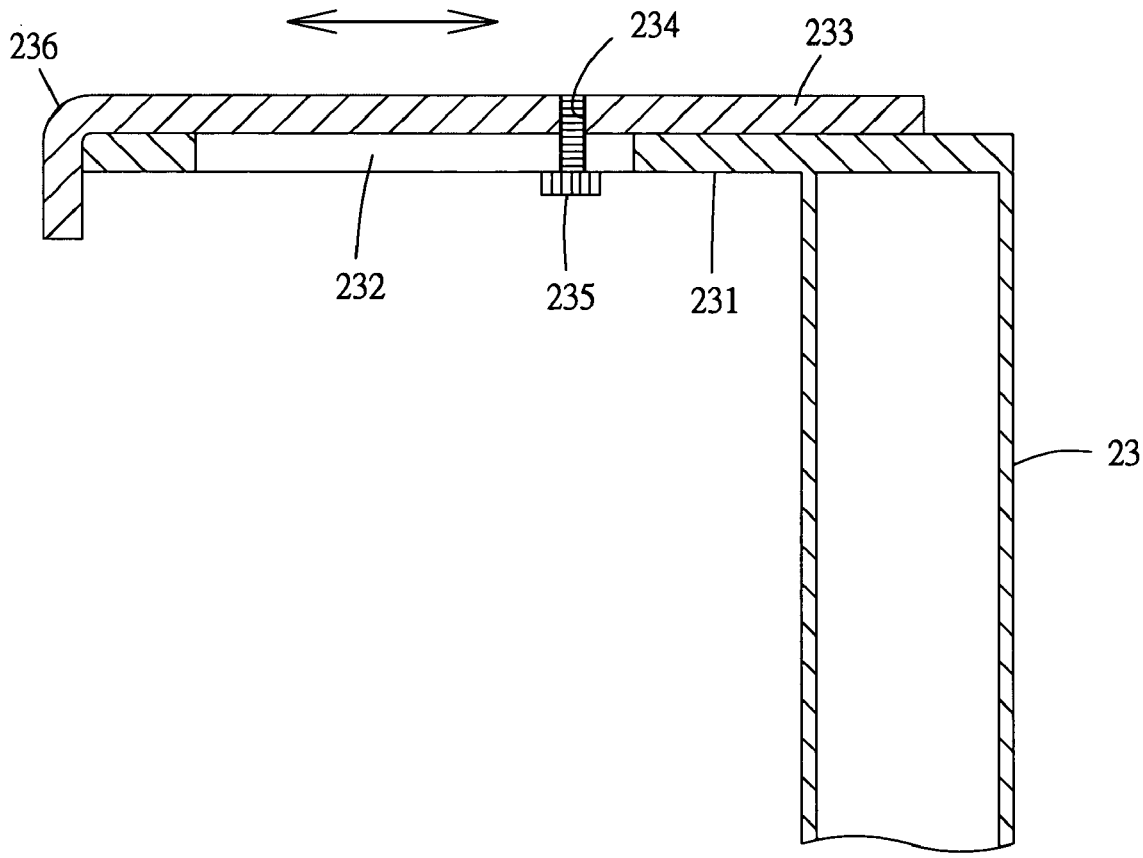
FIG. 6 is a front cross-sectional view of a propping plate being adjusted and shifted in the present invention.
Figure 7:
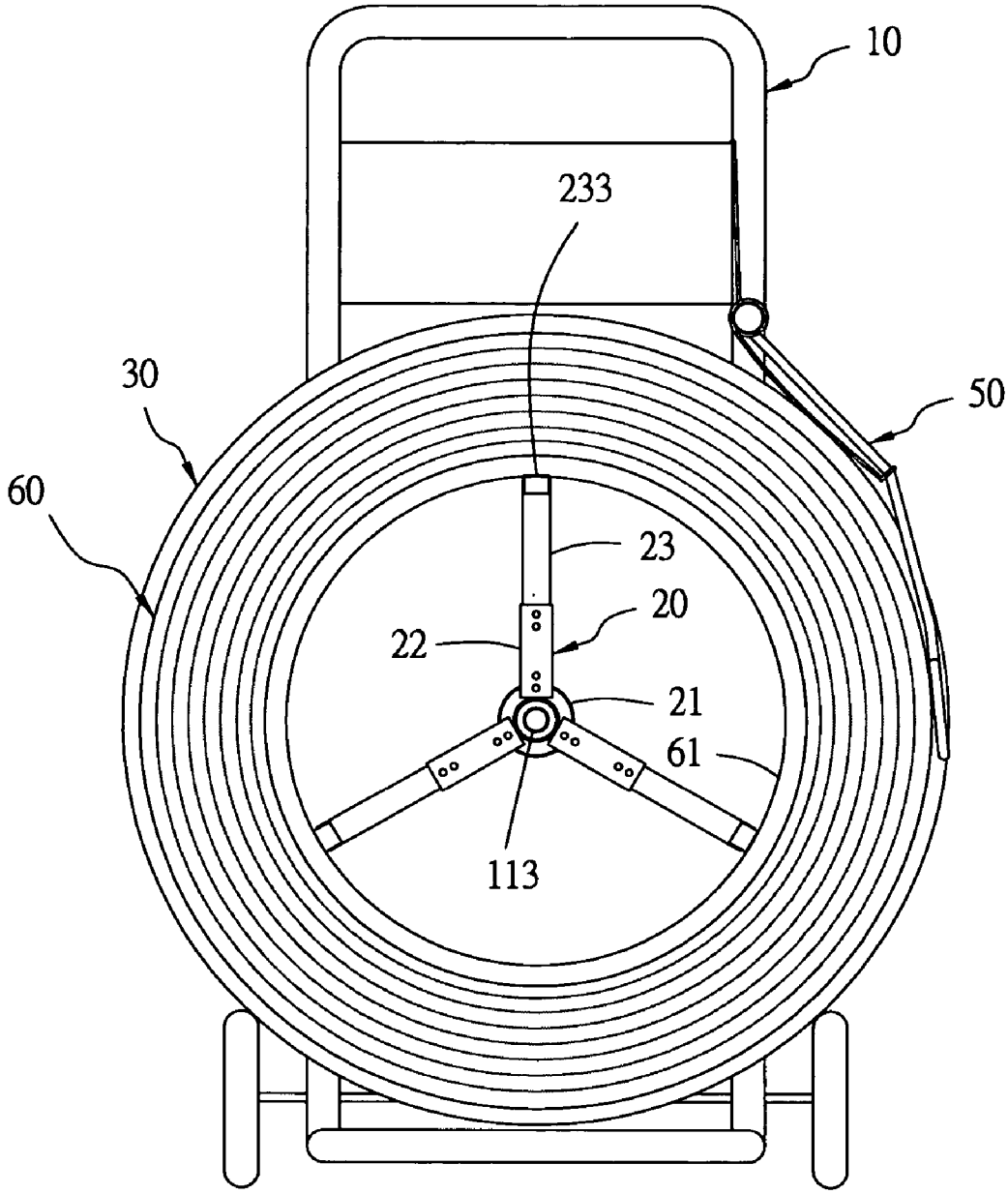
FIG. 7 is front view of the packing strap supported by the telescopic rod unit in the present invention.

In using, as shown in FIGS. 3 and 4, firstly, the tightening nut 115 and the outer disc 40 are removed from the shaft 113 of the frame body 10. Next, the support rods 23 of the telescopic rod unit 20 are adjusted and extended to a proper length matching with the size of the inner diameter of the strap reel 61 of the packing strap 60 to be fitted on, as shown in FIG. 5, and the propping plates 233 at the outer ends of the support rods 23 are shifted to proper positions to match with the width of the strap reel 61, as shown in FIG. 6. Subsequently, the strap reel 61 of the packing strap 60 has its inner diameter aligned to the telescopic rod unit 20 and then, guided by the curved guiding surfaces 236 at the front ends of the propping plates 233, the strap reel 61 is fitted on the outer sides of the propping plates 233 of the telescopic rod unit 20, letting the inner side of the packing strap 60 rest on the outer wall of the inner disc 30. Thus, the packing strap 60 can be firmly supported on the telescopic rod unit 20 by its own weight, as shown in FIG. 7.

Figure 8:
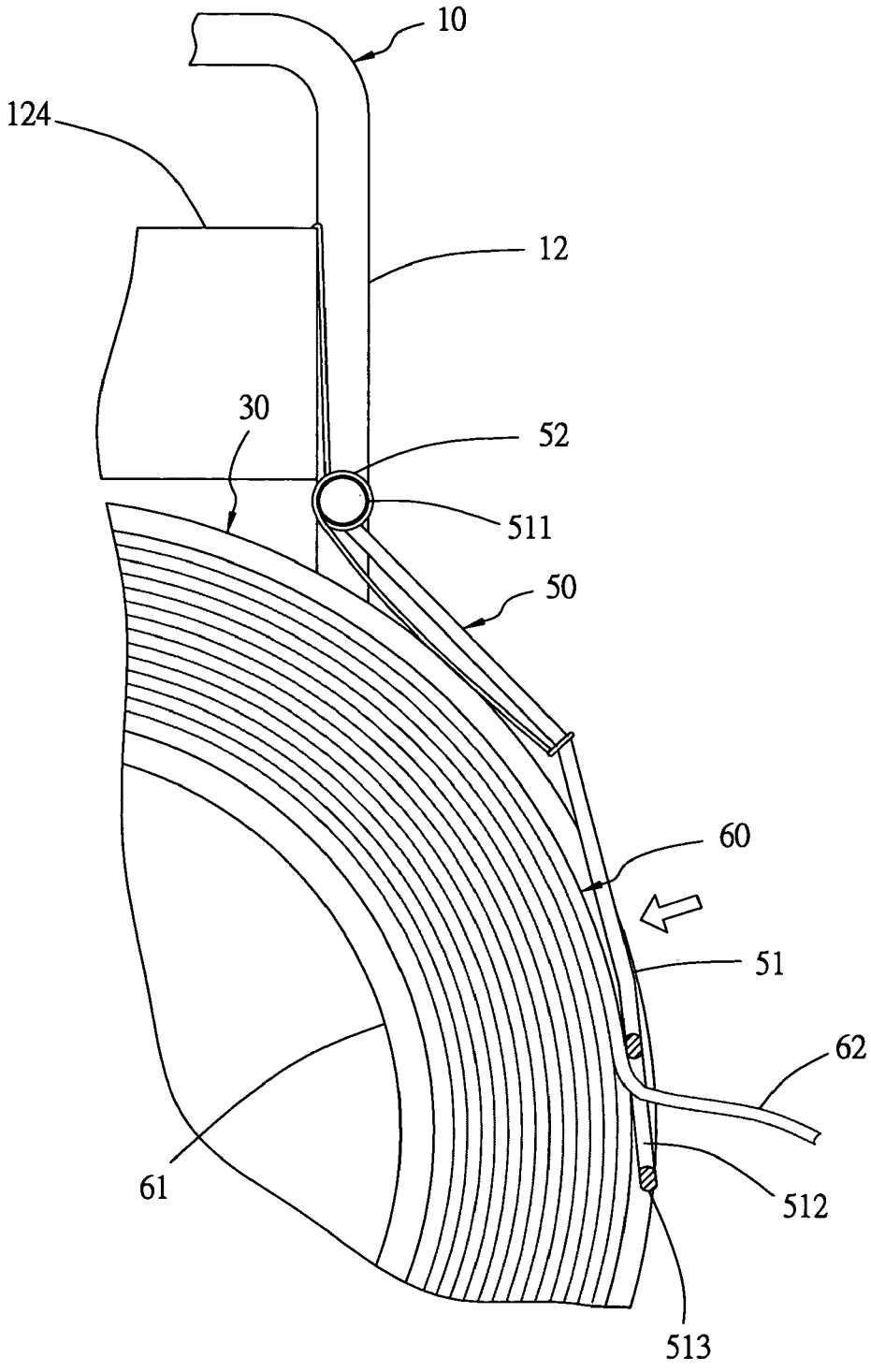
FIG. 8 is a side view of a strap-pressing member pressed on the packing strap in the present invention.

Then, the outer disk 40 is fitted on the shaft 113 of the frame body 10 and the tightening nut 115 is screwed with the male threads 114 at the outer end of the shaft 113 to urge the outer disc 40 to tightly push against the outer side of the packing strap 60. Thus, the packing strap 60 can be supported by the telescopic rod unit 20 and clamped in position by the inner and the outer disc 30, 40 and its outer circumferential side is pressed tight by the strap shoving part 513 of the strap pressing member 50 to prevent the packing strap 60 from rotating randomly. Lastly, the outer end of the packing strap 60 is pulled outward to pass through the strap passing slot 512 of the strap shoving part 513 and elastically pressed by the strap shoving part 513 to finish fitting-on of the packing strap 60, as shown in FIG. 8.

As can be understood from the above description, this invention has the following advantages.

1. The shaft 113 of the frame body 10 is pivotally fitted thereon with a telescopic rod unit 20 provided with three telescopic support rods 23 adjustable in length for matching with different-sized inner diameters of strap reels 61 of the packing strap 60 to be fitted on and supporting the inner wall of the packing strap real 61.

2. The support rods 23 of the telescopic rod unit 20 have their outer ends respectively fitted with a propping plate 233 able to be shifted transversely to match with various packing strap reels 61 of different widths.

3. The push handle 12 and the bottom frame 11 of the stand body 10 are movably fitted together so they can easily be separated from each other, facilitating storing and transporting and saving storing and transporting space.

4. The strap pressing member 50 functions to elastically press the outer circumferential side of the packing strap 60 to prevent the packing strap 60 from rotating randomly, and the outer end of the strap 62 can be pulled out to pass through the strap passing slot 512 and pressed in position by the strap shoving part 513 of the strap pressing member 50, preventing the strap 62 from loosened and facilitating the packing strap 60 to be pulled outward for use.

While the preferred embodiment of the invention has been described above, it will be recognized and understood that various modifications may be made therein and the appended claims are intended to cover all such modifications that may fall within the spirit and scope of the invention.

I claim:

1. A strap reel support device for a strap reel stand comprising:

a stand body having an upper central portion fixed with a transverse shaft extending outward horizontally;

a telescopic rod unit formed with a central base to be movably and axially fitted on said shaft of said frame body, said base of said telescopic rod unit having an outer circumferential wall equidistantly disposed with plural main rods extending outward radially, each said main rod fitted therein with a telescopic support rod, said support rods of said telescopic rod unit having outer ends pushing against and supporting the inner wall of the strap reel of packing strap; and an inner disc and an outer disc respectively bored with a central shaft hole aligned to each other, said shaft hole of said inner and said outer discs fitted on said shaft of said stand body and respectively positioned at the inner and the outer sides of said telescopic rod unit, said inner and said outer discs respectively restricting and positioning the inner and the outer side of said packing strap supported by said telescopic rod unit, wherein said support rods of said telescopic rod unit have interiors respectively fitted with a V-shaped elastic engage plate having one end fixed with an engage stud protruding out of the outer wall of said support rod and able to be elastically pressed inward, said main rods of said telescopic rod unit have walls respectively bored with plural engage holes arranged axially in a line, said support rods being fixed in the interiors of said main rods by means of said engage studs engaged with said engage holes of said main rods.

2. The strap reel support device for a strap reel frame as claimed in claim 1, wherein said base of said telescopic rod unit has said outer circumferential wall equidistantly disposed with three main rods extending outward radially.

3. The strap reel support device for a strap reel frame as claimed in claim 1, wherein said stand body is provided with a fixing rod extending forward at a proper location above said shaft, and a strap pressing member has an upper end mounted on said fixing rod, said strap pressing member formed with a curved press rod, said curved press rod having an upper end fixed with a sleeve to be pivotally fitted with said fixing rod of said frame body, said curved press rod having a lower end bent into a strap shoving part, said curved press rod having said upper end fitted with a torsion spring to make said strap shoving part of said press rod pressed on the outer circumferential side of said packing strap, said strap shoving part formed with a strap passing slot for a packing strap pulled outward to pass therethrough and be pressed in position by said strap shoving part.

4. The strap reel support device for a strap reel frame as claimed in claim 1, wherein said stand body is provided with a bottom frame and a push handle, said bottom frame having the opposite sides of an upper end respectively extending upward and forming an insert rod, said push handle having the opposite sides of a lower end respectively formed with a sleeve to be fitted with said insert rod of said bottom frame, a bolt screwed in the wall of said sleeve for fixing said insert rod of said bottom frame in the interior of said sleeve of said push handle.

5. The strap reel support device for a strap reel frame as claimed in claim 1, wherein said shaft of said stand body has an outer end formed with male threads for a tightening nut to be screwed thereon to push tightly said outer disc.

6. A strap reel support device for a strap reel stand comprising:

a stand body having an upper central portion fixed with a transverse shaft extending outward horizontally;

a telescopic rod unit formed with a central base to be movably and axially fitted on said shaft of said frame body, said base of said telescopic rod unit having an outer circumferential wall equidistantly disposed with plural main rods extending outward radially, each said main rod fitted therein with a telescopic support rod, said support rods of said telescopic rod unit having outer ends pushing against and supporting the inner wall of the strap reel of packing strap; and an inner disc and an outer disc respectively bored with a central shaft hole aligned to each other, said shaft hole of said inner and said outer discs fitted on said shaft of said stand body and respectively positioned at the inner and the outer sides of said telescopic rod unit, said inner and said outer discs respectively restricting and positioning the inner and the outer side of said packing strap supported by said telescopic rod unit.

wherein said support rods of said telescopic rod unit have said outer ends respectively fitted with a propping plate having a front end bent inward to form a curved guiding surface.

7. The strap reel support device for a strap reel frame as claimed in claim 6, wherein said support rods of said telescopic rod unit have said outer ends respectively formed integral with a basic plate with a transverse guiding slot, and said propping plates of said telescopic rod unit are respectively bored with a threaded hole at a proper location, a bolt inserted through said transverse guiding slot and screwed with said threaded hole to enable said propping plate to shift transversely on said basic plate.

8. The strap reel support device for a strap reel frame as claimed in claim 6, wherein said base of said telescopic rod unit has said outer circumferential wall equidistantly disposed with three main rods extending outward radially.

9. The strap reel support device for a strap reel frame as claimed in claim 6, wherein said stand body is provided with a fixing rod extending forward at a proper location above said shaft, and a strap pressing member has an upper end mounted on said fixing rod, said strap pressing member formed with a curved press rod, said curved press rod having an upper end fixed with a sleeve to be pivotally fitted with said fixing rod of said frame body, said curved press rod having a lower end bent into a strap shoving part, said curved press rod having said upper end fitted with a torsion spring to make said strap shoving part of said press rod pressed on the outer circumferential side of said packing strap, said strap shoving part formed with a strap passing slot for a packing strap pulled outward to pass therethrough and be pressed in position by said strap shoving part.

10. The strap reel support device for a strap reel frame as claimed in claim 6, wherein said stand body is provided with a bottom frame and a push handle, said bottom frame having the opposite sides of an upper end respectively extending upward and forming an insert rod, said push handle having the opposite sides of a lower end respectively formed with a sleeve to be fitted with said insert rod of said bottom frame, a bolt screwed in the wall of said sleeve for fixing said insert rod of said bottom frame in the interior of said sleeve of said push handle.

11. The strap reel support device for a strap reel frame as claimed in claim 6, wherein said shaft of said stand body has an outer end formed with male threads for a tightening nut to be screwed thereon to push tightly said outer disc.

* * * * *